US010280801B2

(12) United States Patent
Hafner et al.

(10) Patent No.: US 10,280,801 B2
(45) Date of Patent: May 7, 2019

(54) TURBINE COMPONENT AND TURBINE SHROUD ASSEMBLY

(71) Applicant: GENERAL ELECTRIC COMPANY, Schenectady, NY (US)

(72) Inventors: Matthew Troy Hafner, Honea Path, SC (US); Frederic Woodrow Roberts, Jr., Simpsonville, SC (US); Glenn Curtis Taxacher, Simpsonville, SC (US)

(73) Assignee: General Electric Company, Schenectady, NY (US)

( * ) Notice: Subject to any disclaimer, the term of this patent is extended or adjusted under 35 U.S.C. 154(b) by 204 days.

(21) Appl. No.: 15/623,715

(22) Filed: Jun. 15, 2017

(65) Prior Publication Data

US 2018/0363508 A1 Dec. 20, 2018

(51) Int. Cl.

| | |
|---|---|
| ***F01D 25/00*** | (2006.01) |
| ***F01D 25/26*** | (2006.01) |
| ***F01D 9/04*** | (2006.01) |
| ***F01D 11/08*** | (2006.01) |

(52) U.S. Cl.

CPC ..... *F01D 25/26* (2013.01); *F01D 9/04* (2013.01); *F01D 11/08* (2013.01); *F01D 25/005* (2013.01); *F05D 2240/11* (2013.01); *F05D 2260/30* (2013.01); *F05D 2300/175* (2013.01); *F05D 2300/603* (2013.01)

(58) Field of Classification Search

CPC ..... F01D 9/04; F01D 11/08; F05D 2240/11

See application file for complete search history.

(56) References Cited

U.S. PATENT DOCUMENTS

| | | | | |
|---|---|---|---|---|
| 6,315,519 | B1 | 11/2001 | Bagepalli et al. | |
| 6,726,448 | B2 * | 4/2004 | McGrath | F01D 11/12 415/173.3 |
| 6,758,653 | B2 | 7/2004 | Morrison | |
| 6,814,538 | B2 * | 11/2004 | Thompson | F01D 11/08 29/889.1 |
| 7,278,820 | B2 * | 10/2007 | Keller | F01D 11/08 415/173.1 |
| 8,047,773 | B2 * | 11/2011 | Bruce | F01D 25/04 415/173.3 |

(Continued)

*Primary Examiner* — Hieu T Vo
*Assistant Examiner* — Sherman D Manley
(74) *Attorney, Agent, or Firm* — McNees Wallace & Nurick LLC

(57) ABSTRACT

A turbine component including an outer shroud arranged within a turbine and including opposed extending portions. An inner shroud shields the outer shroud from a gas flowing along a gas path within the turbine during its operation and including opposed first and second arcuate portions extending around and in direct contact with a corresponding extending portion of the outer shroud. A first pin and second pin have a respective first end and second end. The first arcuate portion having a first engagement region for engaging the first end, and second arcuate portion having a second engagement region for engaging the second end. In response to engagement of the first engagement region and the first end of the first pin, and engagement of the second engagement region and the second end of the second pin, the inner shroud is prevented from twisting relative to the outer shroud.

19 Claims, 2 Drawing Sheets

(56) References Cited

U.S. PATENT DOCUMENTS

| | | | | |
|---|---|---|---|---|
| 8,905,709 | B2 * | 12/2014 | Dziech | F01D 11/005 415/173.1 |
| 9,458,726 | B2 * | 10/2016 | Lamusga | F01D 11/08 |
| 9,945,243 | B2 * | 4/2018 | O'Leary | F01D 11/12 |
| 9,970,310 | B2 * | 5/2018 | McCaffrey | F01D 11/08 |
| 2015/0226124 | A1 * | 8/2015 | Tsutsumi | F01D 25/246 415/193 |
| 2016/0348527 | A1 * | 12/2016 | Vetters | F01D 9/04 |
| 2017/0002674 | A1 * | 1/2017 | Vetters | F01D 25/246 |
| 2017/0145845 | A1 * | 5/2017 | Vetters | F01D 9/02 |
| 2018/0195403 | A1 * | 7/2018 | Kerns | F04D 29/083 |
| 2018/0238193 | A1 * | 8/2018 | Baucco | F01D 25/246 |
| 2018/0363504 | A1 * | 12/2018 | Taxacher | F01D 25/246 |

* cited by examiner

TURBINE COMPONENT AND TURBINE SHROUD ASSEMBLY

FIELD OF THE INVENTION

The present invention is directed to turbine components and turbine shroud assemblies. More particularly, the present invention is directed to turbine components and turbine shroud assemblies wherein shroud pins include anti-rotation tips.

BACKGROUND OF THE INVENTION

Hot gas path components of gas turbines are subjected to high air loads and high acoustic loads during operation which, combined with the elevated temperatures and harsh environments, may damage the components over time. Both metal and ceramic metallic matrix ("CMC") components may be vulnerable to such damage, although CMC components are typically regarded as being more susceptible than metallic counterparts, particularly where CMC components are adjacent to metallic components.

Damage from air loads and acoustic loads may be pronounced in certain components, such as turbine shrouds, which include a hot gas path-facing sub-component which is not fully secured to, but in contact with, a non-hot gas path-facing sub-component. By way of example, due to air loads and acoustic loads, the inner shroud of a turbine shroud assembly may vibrate against and be damaged by the outer shroud during operation. Additionally, inner shrouds may rotate relative to the outer shrouds during operation. For example, transiently, turbine blades may rub the shroud, imparting a circumferential load on the shroud, which can cause the inner shroud to twist since the center of the blade is aft of the center of the shroud.

BRIEF DESCRIPTION OF THE INVENTION

In an exemplary embodiment, a turbine component includes an outer shroud arranged within a turbine and further including opposed extending portions. The turbine component further includes an inner shroud shielding the outer shroud from a gas flowing along a gas path within the turbine during operation of the turbine and includes opposed first and second arcuate portions extending around and in direct contact with a corresponding extending portion of the outer shroud for supporting the inner shroud from the outer shroud. The turbine component further includes a first pin having a first end; and a second pin having a second end. The turbine component further includes the first arcuate portion having a first engagement region for engaging the first end and second arcuate portion having a second engagement region for engaging the second end. In response to engagement of the first engagement region and the first end of the first pin, and engagement of the second engagement region and the second end of the second pin, the inner shroud is prevented from twisting relative to the outer shroud.

In another exemplary embodiment, a turbine shroud assembly includes an outer shroud arranged within a turbine and including an upstream edge and an opposed downstream edge each extending along a circumferential length. The turbine shroud assembly further includes a first pin having a first end, and a second pin having a second end. The turbine shroud assembly further includes an inner shroud including an upstream portion and an opposed downstream portion each extending along a circumferential length and each having an arcuate shape defining an upstream slot and a downstream slot receiving and in direct contact with respectively the upstream edge and the downstream edge of the outer shroud for supporting the inner shroud and for shielding the outer shroud from a gas flowing along a gas path within the turbine. The turbine shroud assembly further includes the upstream slot having a first engagement slot for engaging the first end of the first pin, the downstream slot having a second engagement slot for engaging the second end of the second pin. In response to engagement of the first engagement slot and the first end of the first pin, and engagement of the second engagement slot and the second end of the second pin, the inner shroud is prevented from twisting relative to the outer shroud.

Other features and advantages of the present invention will be apparent from the following more detailed description of the preferred embodiment, taken in conjunction with the accompanying drawings, which illustrate, by way of example, the principles of the invention.

BRIEF DESCRIPTION OF THE DRAWINGS

Wherever possible, the same reference numbers will be used throughout the drawings to represent the same parts.

DETAILED DESCRIPTION OF THE INVENTION

Provided are exemplary turbine components, such as anti-rotation shroud pins and turbine shroud assemblies. Embodiments of the present disclosure, in comparison to articles not utilizing one or more features disclosed herein, improve component performance, increase component life, decrease maintenance requirements, inhibit or prevent inner shroud rotation, inhibit or prevent pin rotation, decrease pin shearing, or combinations thereof.

Figure 1:
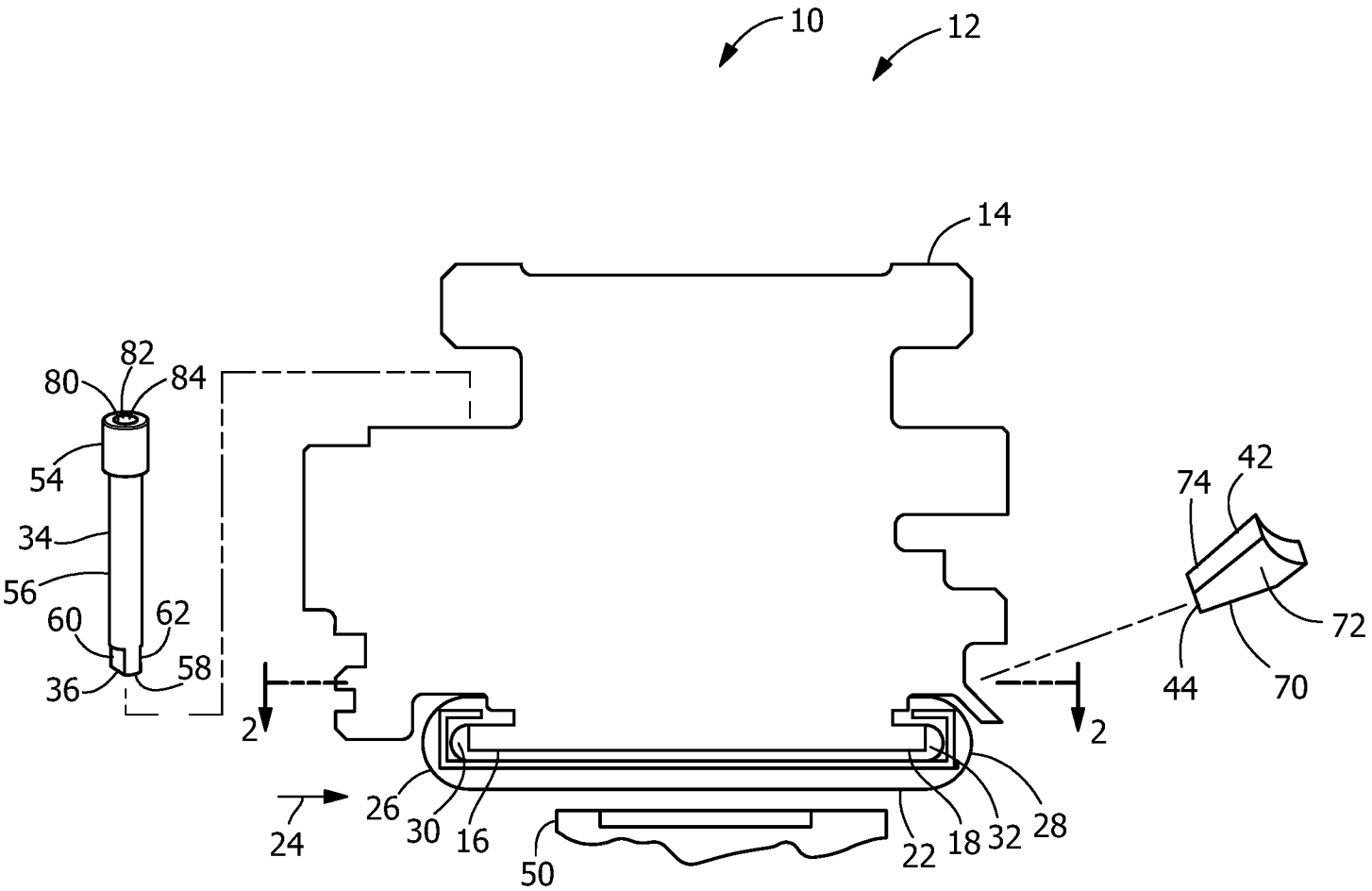
FIG. 1 is an elevation view of a shroud assembly, according to an embodiment of the present disclosure.

Referring to FIG. 1, a gas turbine 10 includes a shroud assembly 12 having an outer shroud 14 arranged within the gas turbine. Outer shroud 14 includes opposed extending portions 16, 18 or an upstream edge or portion 16 and an opposed downstream edge or portion 18 extending along a circumferential length. An inner shroud 22 extends along a circumferential length adjacent outer shroud 14 and shields the outer shroud from a gas, such as a hot gas 24 flowing along a hot gas path within gas turbine 10 during operation of the gas turbine. Inner shroud 22 comprises an arcuate upstream portion 26 defining an upstream slot 30 for receiving in direct contact upstream edge or portion 16 of outer shroud 14, and an arcuate downstream portion 28 defining a downstream slot 32 for receiving in direct contact downstream edge or portion 18 of outer shroud 14.

As further shown in FIG. 1, a pin 34 having an end 36 is inserted into outer shroud 14 until end 36 engages an engagement region 40 (FIG. 2), such as an engagement slot of upstream slot 30 of arcuate upstream portion 26. A pin 42 having an end 44 is inserted into outer shroud 14 until end 44 engages an engagement region 48 (FIG. 2), such as an engagement slot of downstream slot 32 of arcuate downstream portion 28. As a result of engagement of engagement region 40 and end 36 of pin 34, and engagement of engagement region 48 and end 44 of pin 42, inner shroud 22 is prevented from twisting relative to outer shroud 14. Twisting of inner shroud 22 may otherwise occur in response to a hard rub between a rotating blade tip 50 and the inner shroud. The engaged ends 36, 44 of respective pins 34, 42 are arranged and disposed so as not to subject inner shroud 22 to radial loading during operation of the gas turbine.

The terms "engagement region" and "engagement slot" and the like may be used interchangeably.

Figure 2:
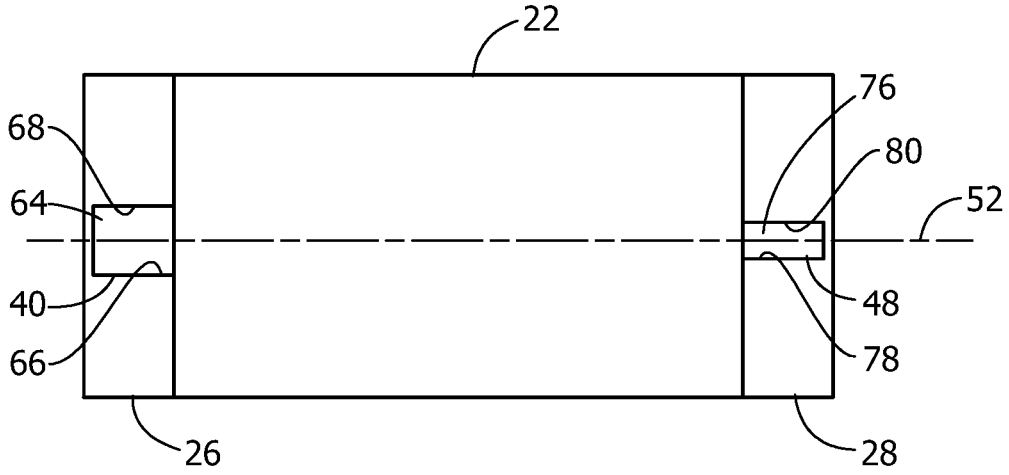
FIG. 2 is a plan view of an inner shroud taken along lines 2-2 of FIG. 1, according to the present disclosure.

As shown in FIG. 2, which is a plan view of inner shroud 22 taken along lines 2-2 of FIG. 1, engagement region 40 and engagement region 48 are aligned with each other, such as with axis 52. As further shown in FIG. 2, engagement region 40 and engagement region 48 are each generally centered relative to a corresponding arcuate portion or upstream portion 26 and arcuate portion or downstream portion 28. In one embodiment, engagement region 40 and engagement region 48 are not axially aligned. In one embodiment, at least one of engagement region 40 and engagement region 48 are not generally centered relative to a corresponding arcuate portion or upstream portion 26 and arcuate portion or downstream portion 28. In one embodiment, as a result of engagement of engagement region 40 and end 36 of pin 34, and engagement of engagement region 48 and end 44 of pin 42, respective pins 34, 44 are prevented from rotating.

Referring back to FIG. 1, pin 34 includes a cap 54 positioned at an end of pin 34 opposite of or distal from an end 36. As shown, cap 54 may include an extraction interface 82. In one embodiment, extraction interface 82 includes a bore 84. Bore 84 may be a threaded bore 86 or may include any suitable securing feature for a tool to exert a pulling force upon. In one embodiment, both pins 34, 42 may include a similarly positioned/configured cap. The pins may be secured in an engaged position to outer shroud 14 by staking, welding or brazing, a pin, a retaining ring, a C-clamp, and a threaded fastener.

Pin 34 includes a shaft 56 positioned between 54 and end 36. The cross-section of shaft 56 may resemble a circle, an ellipse, a triangle, a quadrilateral, a pentagon, a hexagon, a polygon, rounded variations thereof, and combinations thereof. As shown, end 36 of pin 34 includes contact surfaces 58, 60, 62 for engagement with respective contact surfaces 64, 66, 68 of engagement region/engagement slot 40 (FIG. 2). As further shown, end 44 of pin 42 includes contact surfaces 70, 72, 74 for engagement with respective contact surfaces 76, 78, 80 of engagement region/engagement slot 48 (FIG. 2). In one embodiment, at least one pair of the corresponding contact surfaces are essentially planar. As used herein, "essentially planar" indicates that the surface is planar, excepting de minimus surface imperfections, textures, and distortions.

Pins 34, 42 may include any suitable material composition, including, but not limited to, high alloy steels, CrMo steels, superalloys, nickel-based superalloys, cobalt-based superalloys, cobalt L-605, CRUCIBLE 422, INCONEL 718, INCONEL X-750, or combinations thereof.

As used herein, "high alloy steel" refers to a steel that, in additional to carbon, iron is alloyed with at least, by weight, about 4% additional elements, alternatively at least about 8% additional elements. Suitable additional elements include, but are not limited to, manganese, nickel, chromium, molybdenum, vanadium, silicon, boron, aluminum, cobalt, cerium, niobium, titanium, tungsten, tin, zinc, lead, and zirconium.

As used herein, "cobalt L-605" refers to an alloy including a composition, by weight, of about 20% chromium, about 10% nickel, about 15% tungsten, about 0.1% carbon, about 1.5% manganese, and a balance of cobalt. Cobalt L-605 is available from Special Metals Corporation, 3200 Riverside Drive, Huntington, W. Va. 25720.

As used herein, "CrMo steel" refers to a steel alloyed with at least chromium and molybdenum. In one embodiment, the CrMo steels are 41xx series steels as specified by the Society of Automotive Engineers.

As used herein, "CRUCIBLE 422" refers to an alloy including a composition, by weight, of about 11.5% chromium, about 1% molybdenum, about 0.23% carbon, about 0.75% manganese, about 0.35% silicon, about 0.8% nickel, about 0.25% vanadium, and a balance of iron. CRUCIBLE 422 is available from Crucible Industries LLC, 575 State Fair Boulevard, Solvay, N.Y., 13209.

As used herein, "INCONEL 718" refers to an alloy including a composition, by weight, of about 19% chromium, about 18.5% iron, about 3% molybdenum, about 3.6% niobium and tantalum, and a balance of nickel. INCONEL 718 is available from Special Metals Corporation, 3200 Riverside Drive, Huntington, W. Va. 25720.

As used herein, "INCONEL X-750" refers to an alloy including a composition, by weight, of about 15.5% chromium, about 7% iron, about 2.5% titanium, about 0.7% aluminum, and about 0.5% niobium and tantalum, and a balance of nickel. INCONEL X-750 is available from Special Metals Corporation, 3200 Riverside Drive, Huntington, W. Va. 25720.

Inner shroud 22 may include any suitable material composition, including, but not limited to, CMCs, aluminum oxide-fiber-reinforced aluminum oxides (Ox/Ox), carbon-fiber-reinforced silicon carbides (C/SiC), silicon-carbide-fiber-reinforced silicon carbides (SiC/SiC), carbon-fiber-reinforced silicon nitrides ($C/Si_3N_4$), silicon-carbide-fiber-reinforced silicon nitrides ($SiC/Si_3N_4$), superalloys, nickel-based superalloys, cobalt-based superalloys, INCONEL 718, INCONEL X-750, cobalt L-605, or combinations thereof.

Outer shroud 14 may include any suitable material composition, including, but not limited to, iron alloys, steels, stainless steels, carbon steels, nickel alloys, superalloys, nickel-based superalloys, cobalt-based superalloys, or combinations thereof.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A turbine component comprising:

an outer shroud arranged within a turbine and further comprising opposed extending portions;

an inner shroud shielding the outer shroud from a gas flowing along a gas path within the turbine during operation of the turbine and comprising opposed first and second arcuate portions extending around and in direct contact with a corresponding extending portion of the outer shroud for supporting the inner shroud from the outer shroud;

a first pin having a first end; and a second pin having a second end;

wherein the first arcuate portion having a first engagement region for engaging the first end and second arcuate portion having a second engagement region for engaging the second end;

wherein in response to engagement of the first engagement region and the first end of the first pin, and engagement of the second engagement region and the second end of the second pin, the inner shroud is prevented from twisting relative to the outer shroud.

2. The turbine component of claim 1, wherein the first engagement region and the second engagement region are aligned.

3. The turbine component of claim 2, wherein the first engagement region and the second engagement region are each generally centered relative to a corresponding first arcuate portion and second arcuate portion.

4. The turbine component of claim 1, wherein engagement of the first engagement region and the first end of the first pin, and engagement of the second engagement region and the second end of the second pin does not subject the inner shroud to radial loading during operation of the turbine.

5. The turbine component of claim 1, wherein at least one of the first pin and the second pin includes a material composition selected from the group consisting of high alloy steels, CrMo steels, superalloys, nickel-based superalloys, cobalt-based superalloys, cobalt L-605, CRUCIBLE 422, INCONEL 718, INCONEL X-750, and combinations thereof.

6. The turbine component of claim 1, wherein in response to engagement of the first engagement region and the first end of the first pin, and engagement of the second engagement region and the second end of the second pin, the first pin and the second pin are prevented from rotating.

7. The turbine component of claim 1, wherein the first pin is secured in an engaged position selected from the group consisting of staking, welding or brazing, a pin, a retaining ring, a C-clamp, and a threaded fastener.

8. The turbine component of claim 1, wherein at least one of the first pin and the second pin includes a cap positioned distal from a corresponding first end and second end.

9. The turbine component of claim 8, wherein the cap includes an extraction interface.

10. A turbine shroud assembly comprising:

an outer shroud arranged within a turbine and comprising an upstream edge and an opposed downstream edge each extending along a circumferential length;

a first pin having a first end; and a second pin having a second end;

an inner shroud comprising an upstream portion and an opposed downstream portion each extending along a circumferential length and each having an arcuate shape defining an upstream slot and a downstream slot receiving and in direct contact with respectively the upstream edge and the downstream edge of the outer shroud for supporting the inner shroud and for shielding the outer shroud from a gas flowing along a gas path within the turbine;

wherein the upstream slot having a first engagement slot for engaging the first end of the first pin, the downstream slot having a second engagement slot for engaging the second end of the second pin, wherein in response to engagement of the first engagement slot and the first end of the first pin, and engagement of the second engagement slot and the second end of the second pin, the inner shroud is prevented from twisting relative to the outer shroud.

11. The turbine shroud assembly of claim 10, wherein the first engagement slot and the second engagement slot are aligned.

12. The turbine shroud assembly of claim 10, wherein the first engagement slot and the second engagement slot are each generally centered relative to a corresponding upstream slot and downstream slot.

13. The turbine shroud assembly of claim 10, wherein engagement of the first engagement slot and the first end of the first pin, and engagement of the second engagement slot and the second end of the second pin does not subject the inner shroud to radial loading during operation of the turbine.

14. The turbine shroud assembly of claim 10, wherein at least one of the first pin and the second pin includes a material composition selected from the group consisting of high alloy steels, CrMo steels, superalloys, nickel-based superalloys, cobalt-based superalloys, cobalt L-605, CRUCIBLE 422, INCONEL 718, INCONEL X-750, and combinations thereof.

15. The turbine shroud assembly of claim 10, wherein in response to the first engagement slot engaging the first end of the first pin, and the second engagement slot engaging the second end of the second pin, the first pin and the second pin are prevented from rotating.

16. The turbine shroud assembly of claim 10, wherein the first pin and the second pin are secured in an engaged position selected from the group consisting of staking, welding or brazing, a pin, a retaining ring, a C-clamp, and a threaded fastener.

17. The turbine shroud assembly of claim 10, wherein at least one of the first pin and the second pin includes a cap positioned distal from a corresponding first end and second end.

18. The turbine shroud assembly of claim 17, wherein the cap includes an extraction interface.

19. The turbine shroud assembly of claim 10, wherein the inner shroud includes a composition selected from the group consisting of ceramic matrix composites (CMC), aluminum oxide-fiber-reinforced aluminum oxides (Ox/Ox), carbon-fiber-reinforced silicon carbides (C/SiC), silicon-carbide-fiber-reinforced silicon carbides (SiC/SiC), carbon-fiber-reinforced silicon nitrides ($C/Si_3N_4$), silicon-carbide-fiber-reinforced silicon nitrides ($SiC/Si_3N_4$), and combinations thereof.

* * * * *